US006294866B1

(12) United States Patent
Uchida et al.

(10) Patent No.: US 6,294,866 B1
(45) Date of Patent: Sep. 25, 2001

(54) COLOR CATHODE RAY TUBE HAVING A LOW-DISTORTION ELECTROSTATIC QUADRUPOLE LENS WITH A PLURALITY OF FIRST AND SECOND ELECTRODES HAVING SPECIFIED SPACING RELATIONSHIPS

(75) Inventors: Go Uchida; Shoji Shirai; Shinichi Kato, all of Mobara; Masafumi Nagaoka, Sakura, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/238,512

(22) Filed: Jan. 27, 1999

(30) Foreign Application Priority Data

Jan. 30, 1998 (JP) ..... 10-019605

(51) Int. Cl.[7] ..... H01J 29/50; H01J 29/70; H01J 29/46

(52) U.S. Cl. ..... 313/414; 313/421; 313/426; 313/441; 313/444

(58) Field of Search ..... 313/409–412, 313/414, 440, 441, 426, 444, 427, 449, 432, 452, 460, 428, 421; 315/382.1, 16

(56) References Cited

U.S. PATENT DOCUMENTS 4,772,827 * 9/1988 Osakabe ..... 313/414 X
5,015,910 * 5/1991 Takahashi et al. ..... 313/414
5,656,884 8/1997 Lee .
5,739,630 * 4/1998 Shirai et al. ..... 313/414
5,814,829 * 9/1998 Jo ..... 313/414

FOREIGN PATENT DOCUMENTS 1-236551 * 9/1989 (JP) .
2-46632 * 2/1990 (JP) .
2-79340 * 3/1990 (JP) .
2-189842 * 7/1990 (JP) .
3-233839 * 10/1991 (JP) .
7-94120 * 4/1995 (JP) .
9-17353 * 1/1997 (JP) .

* cited by examiner

*Primary Examiner*—Nimeshkumar D. Patel
*Assistant Examiner*—Mack Haynes
(74) *Attorney, Agent, or Firm*—Antonelli, Terry, Stout & Kraus, LLP

(57) ABSTRACT

A color cathode ray tube includes a phosphor screen, an electron beam generating section for generating three in-line electron beams, a focus electrode and an anode. The focus electrode includes a first focus and second focus sub-electrodes on this order from the cathode structure. The first focus sub-electrode has plural vertical parallel plate-like electrodes arranged to sandwich respective beam apertures in an end thereof facing the second focus sub-electrode in a direction of a beam arrangement, and the second focus sub-electrode has plural horizontal parallel plate-like electrodes arranged to sandwich beam apertures in an end thereof facing the first focus sub-electrode in a direction perpendicular to the beam arrangement, one of the first and second focus sub-electrodes is adapted to be supplied with a voltage varying in synchronism with beam deflection. The vertical parallel plate-like electrodes extend into a space defined by the horizontal parallel plate-like electrodes, and a vertical spacing V between the horizontal parallel plate-like electrodes and a gap L between the horizontal parallel plate-like electrodes and the edges of the vertical parallel plate-like electrodes satisfy $0.38 \leqq L/(V/2) \leqq 0.58$.

4 Claims, 9 Drawing Sheets

COLOR CATHODE RAY TUBE HAVING A LOW-DISTORTION ELECTROSTATIC QUADRUPOLE LENS WITH A PLURALITY OF FIRST AND SECOND ELECTRODES HAVING SPECIFIED SPACING RELATIONSHIPS

BACKGROUND OF THE INVENTION

The present invention relates to a color cathode ray tube having an electron gun configured to project three electron beams toward a phosphor screen.

In color cathode ray tubes for use in TV receiver sets or monitors, spot shapes of the electron beams on the screen have to be properly controlled with increase in beam deflection to provide good focus and high resolution over the entire phosphor screen (also referred to merely as the screen or the picture area).

FIG. 5 is a longitudinal cross-sectional view of a color cathode ray tube for explaining its overall structure, to which the present invention is applied. Reference numeral 31 denotes a panel portion for carrying a screen, 32 is a neck portion for housing an electron gun, 33 is a funnel portion for connecting the panel portion 31 and the neck portion 32, 34 is a phosphor screen coated on the inner surface of the panel portion 31, 35 is a shadow mask serving as a color selection electrode, 36 is a mask frame for supporting the shadow mask 35, 37 is a magnetic shield for shielding external magnetic fields, 38 is springs for suspending the shadow mask 35, 39 is an electron gun for projecting three electron beams arranged in a line, 40 is a deflection yoke, 41 is a magnet assembly for centering the beams and adjusting color purity and convergence of the beams, B denotes three electron beams arranged in a line (two side beams SB and one center beam CB).

The vacuum envelope of this color cathode ray tube is formed of the panel portion 31, the neck portion 32, and the funnel portion 33 around which the deflection yoke 40 is mounted. The electron gun 39 housed in the neck portion 32 projects the three in-line beams B toward the phosphor screen 34. The deflection yoke 40 mounted around the transition region between the funnel portion 33 and the neck portion 32 generates the magnetic field for deflecting the three electron beams B from the electron gun 39 in two horizontal and vertical directions. The shadow mask 35 is welded to the mask frame 36, and the mask frame 36 is suspended within the panel portion 31 by engaging its suspension springs 38 fixed to its peripheral portions with panel pins embedded in the inner surface of the panel portion 31 such that the shadow mask is spaced a predetermined distance from the phosphor screen 34.

FIG. 6A is a vertical cross-sectional view of a three in-line beam electron gun in a color cathode ray tube for explaining a dimensional relationship of the present invention and the prior art, and FIG. 6B is a cross-sectional view taken along line VIB—VIB of FIG. 6A. Reference numeral 1 denotes a cathode structure, 2 is a beam control electrode, 3 is an accelerating electrode, 4 is a focus electrode, 5 is an anode and 6 is a shield cup. The focus electrode 4 is divided into a first focus sub-electrode 4-1 and a second focus sub-electrode 4-2. The cathode structure 1, the beam control electrode 2 and the accelerating electrode 3 constitute an electron beam generating section.

Thermoelectrons emitted from the heated cathode structure 1 are accelerated toward the beam control electrode 2 by the potential of the accelerating electrode 3 to form three electron beams. The three electron beams pass through the apertures in the beam control electrode 2, then pass through the apertures in the accelerating electrodes 3, are slightly focused by a prefocus lens formed between the accelerating electrode 3 and the first focus sub-electrode 4-1, then are accelerated and enter a main lens 7 formed between the second focus sub-electrode 4-2 and the anode 5. After they are focused by the main lens 7, they pass through apertures in the shadow mask 35 and are focused on the phosphor screen 34 to form three beam spots on the phosphor screen 34.

Four vertical parallel plate-like electrodes 411, 412, 413, 414 (only 413 is visible) and two horizontal parallel plate-like electrodes 421, 422 are attached to the first focus sub-electrode 4-1 and the second focus sub-electrode 4-2, respectively, to form an electrostatic quadrupole lens 8 therebetween.

The electrostatic quadrupole lens 8 are formed by the four vertical parallel plate-like electrodes 411, 412, 413, 414 (only 413 is visible) disposed to sandwich, in a direction of the in-line beam arrangement, respective beam apertures in the end of the first focus sub-electrode 4-1 facing the second focus sub-electrode 4-2 and electrically connected to the first focus sub-electrode 4-1, and a pair of horizontal parallel plate-like electrodes 421, 422 disposed to sandwich, in a direction perpendicular to the in-line beam arrangement, three beam apertures 4-2*a*, 4-2*b*, 4-2*c* in the end of the second focus sub-electrode 4-2 facing the first focus sub-electrode 4-1 and electrically connected to the second focus sub-electrode 4-2.

As shown in FIG. 7, a fixed voltage Vf1 is applied to the first focus sub-electrode 4-1, and a dynamic voltage (Vf2+dVf) varying in synchronism with deflection of the electron beams scanned on the phosphor screen 34 is applied to the second focus sub-electrode 4-2. The anode 5 is supplied with the highest voltage Eb (anode voltage).

With this structure, the strength of the main lens 7 is varied with deflection of the electron beams to correct the curvature of the image field, astigmatism is corrected by the electrostatic quadrupole lens 8 formed by the first and second focus sub-electrodes 4-1, 4-2 with deflection of the electron beams such that focus lengths of the electron beams and the shapes of the beams on the phosphor screen are controlled to provide good focus over the entire phosphor screen 34.

The electrostatic quadrupole lens 8 is configured such that the quadrupole lens is formed in a space where two horizontal parallel plate-like electrodes 421, 422 and four vertical parallel plate-like electrodes 411, 412, 413, 414 overlap each other. The strength of the quadrupole lens increases with increase in the overlapped length of the plate-like electrodes.

The above-described electrostatic quadrupole formed by the first and second sub-electrodes 4-1, 4-2 of the focus electrode 4 in an electron gun are disclosed in Japanese Patent Application Laid-Open No. Sho 61-250934, for example.

The prior art electrostatic quadrupole lens is formed by combination of plate-like electrodes, in a space where horizontal parallel plate-like electrodes and vertical parallel plate-like electrodes are spaced a relatively great distance from each other, a uniform quadrupole lens is produced in the space, but in space where they are spaced a relatively short distance, a greatly distorted quadrupole lens is generated in the space.

When the trajectory of electron beam B is bent in the electron gun due to manufacturing variations in electron guns or color cathode ray tubes, and as a result the electron beam B traverse corners off the axis of the electrostatic quadrupole lens as illustrated in FIG. 6B, the problem arises in that they are influenced by the distorted quadrupole lens action, produce greatly distorted beam spot shapes including a core C and a halo H on the phosphor screen as illustrated in FIG. 6*c* and deteriorate focus characteristics resulting in degradation of resolution.

SUMMARY OF THE INVENTION

It is an object of the present invention to overcome the aforementioned problems with the prior art and to provide a color cathode ray tube having an electron gun capable of preventing deterioration in focus characteristics and in resolution in spite of manufacturing variations in the electron gun or the color cathode ray tube.

In accordance with one embodiment of the present invention, there is provided a color cathode ray tube comprising a phosphor screen, an electron beam generating section for generating three in-line electron beams, a focus electrode and an anode, the focus electrode including at least a first focus sub-electrode and a second focus sub-electrode on the order named from its cathode structure, the first focus sub-electrode having a plurality of vertical parallel plate-like electrodes arranged to sandwich respective beam apertures in an end thereof facing the second focus sub-electrode in a direction of a three in-line electron beam arrangement, the second focus sub-electrode having a plurality of horizontal parallel plate-like electrodes arranged to sandwich beam apertures in an end thereof facing the first focus sub-electrode in a direction perpendicular to the three in-line electron beam arrangement, one of the first focus sub-electrode and the second focus sub-electrode being adapted to be supplied with a voltage varying in synchronism with deflection of the electron beams, the vertical parallel plate-like electrodes extending into a space defined by the horizontal parallel plate-like electrodes, and a vertical spacing V between the horizontal parallel plate-like electrodes and a gap L between the horizontal parallel plate-like electrodes and a top edge of the vertical parallel plate-like electrodes and a gap L between the horizontal parallel plate-like electrodes and a bottom edge of the vertical parallel plate-like electrodes satisfying a following relationship:

$$0.38 \leqq L/(V/2) \leqq 0.58.$$

In accordance with another embodiment of the present invention, there is provided a color cathode ray tube comprising a phosphor screen, an electron beam generating section for generating three in-line electron beams, a focus electrode and an anode, the focus electrode including at least a first focus sub-electrode and a second focus sub-electrode on the order named from its cathode structure, the first focus sub-electrode having a plurality of horizontal parallel plate-like electrodes arranged to sandwich respective beam apertures in an end thereof facing the second focus sub-electrode in a direction perpendicular to a three in-line-electron beam arrangement, the second focus sub-electrode having a plurality of vertical parallel plate-like electrodes arranged to sandwich beam apertures in an end thereof facing the first focus sub-electrode in a direction of the three in-line electron beam arrangement, one of the first focus sub-electrode and the second focus sub-electrode being adapted to be supplied with a voltage varying in synchronism with deflection of the electron beams, the vertical parallel plate-like electrodes extending into space defined by the horizontal parallel plate-like electrodes, and a vertical spacing V between the horizontal parallel plate-like electrodes and a gap L between the horizontal parallel plate-like electrodes and a top edge of the vertical parallel plate-like electrodes and a gap L between the horizontal parallel plate-like electrodes and a bottom edge of the vertical parallel plate-like electrodes satisfying a following relationship:

$$0.39 \leqq L/(V/2) \leqq 0.58.$$

In accordance with still another embodiment of the present invention, there is provided a color cathode ray tube comprising a phosphor screen, an electron beam generating section for generating three in-line electron beams, a focus electrode and an anode, the focus electrode including at least a first focus sub-electrode and a second focus sub-electrode on the order named from its cathode structure, the first focus sub-electrode having a plurality of vertical parallel plate-like electrodes arranged to sandwich respective beam apertures in an end thereof facing the second focus sub-electrode in a direction of a three in-line electron beam arrangement, the second focus sub-electrode having a plurality of horizontal parallel plate-like electrodes arranged to sandwich respective beam apertures in an end thereof facing the first focus sub-electrode in a direction perpendicular to the three in-line electron beam arrangement, one of the first focus sub-electrode and the second focus sub-electrode being adapted to be supplied with a voltage varying in synchronism with deflection of the electron beams, each of the horizontal parallel plate-like electrodes extending into a space defined by two adjacent ones of the vertical parallel plate-like electrodes, and a horizontal spacing H between two adjacent ones of the vertical parallel plate-like electrodes and a horizontal gap M between the horizontal parallel plate-like electrodes and the vertical parallel plate-like electrodes satisfying a following relationship:

$$0.38 \leqq M/(H/2) \leqq 0.58.$$

In accordance with still another embodiment of the present invention, there is provided a color cathode ray tube comprising a phosphor screen, an electron beam generating section for generating three in-line electron beams, a focus electrode and an anode, the focus electrode including at least a first focus sub-electrode and a second focus sub-electrode on the order named from its cathode structure, the first focus sub-electrode having a first plurality of plate-like electrodes parallel in one of two directions parallel and perpendicular to an arrangement of the three electron beams, arranged to sandwich beam apertures in an end thereof facing the second focus sub-electrode in the other of the two directions, the second focus sub-electrode having a second plurality of plate-like electrodes parallel in the other of the two directions, arranged to sandwich beam apertures in an end thereof facing the first focus sub-electrode in the one of the two directions, one of the first focus sub-electrode and the second focus sub-electrode being adapted to be supplied with a voltage varying in synchronism with deflection of the electron beams, one of (i) the first plurality of plate-like electrodes parallel in the one of the two directions and (ii) the second plurality of plate-like electrodes parallel in the other of the two directions extending between the other of (i) the first plurality of plate-like electrodes parallel in the one of the two directions and (ii) the second plurality of plate-like electrodes parallel in the other of the two directions, and a spacing S between two adjacent electrodes of the other of (i) the first plurality of plate-like electrodes parallel in the one of the two directions and (ii) the second plurality of plate-like electrodes parallel in the other of the two directions, and a gap G between one electrode of the one of (i) the first plurality of plate-like electrodes parallel in the one of the two directions and (ii) the second plurality of plate-like electrodes parallel in the other of the two directions satisfying a following relationship:

$$0.38 \leqq G/(S/2) \leqq 0.58.$$

In one of the above embodiments, by increasing the ratio of a gap L between the horizontal parallel plate-like electrodes and the vertical parallel plate-like electrodes to a vertical spacing V between the horizontal parallel plate-like electrodes and consequently reducing the lens strength in spaces where the horizontal parallel plate-like electrodes and the vertical parallel plate-like electrodes are adjacent to each other, distortions in the quadrupole lens caused in those spaces are reduced and deterioration in resolution is prevented to provide a high quality display image.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail hereunder with reference to the accompanying drawings.

Figure 1A:
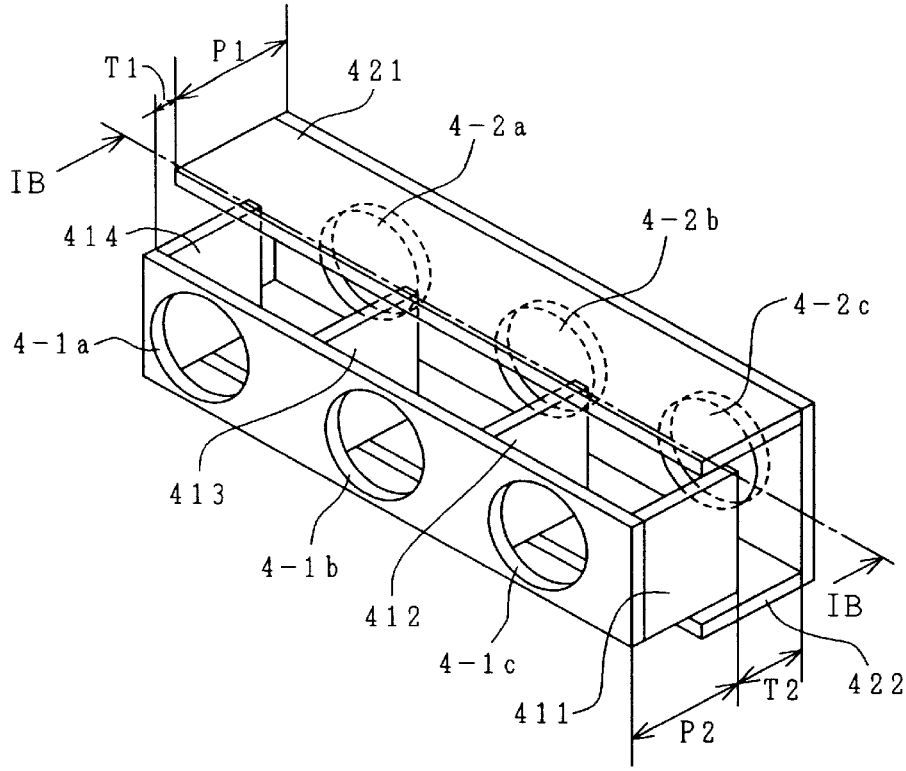
FIGS. 1A and 1B are illustrations of a first embodiment of an electrostatic quadrupole lens used in an electron gun of a color cathode ray tube of the present invention, FIG. 1A being its perspective view and FIG. 1B being its cross-sectional view taken along line IB—IB of FIG. 1A.
Figure 1B:
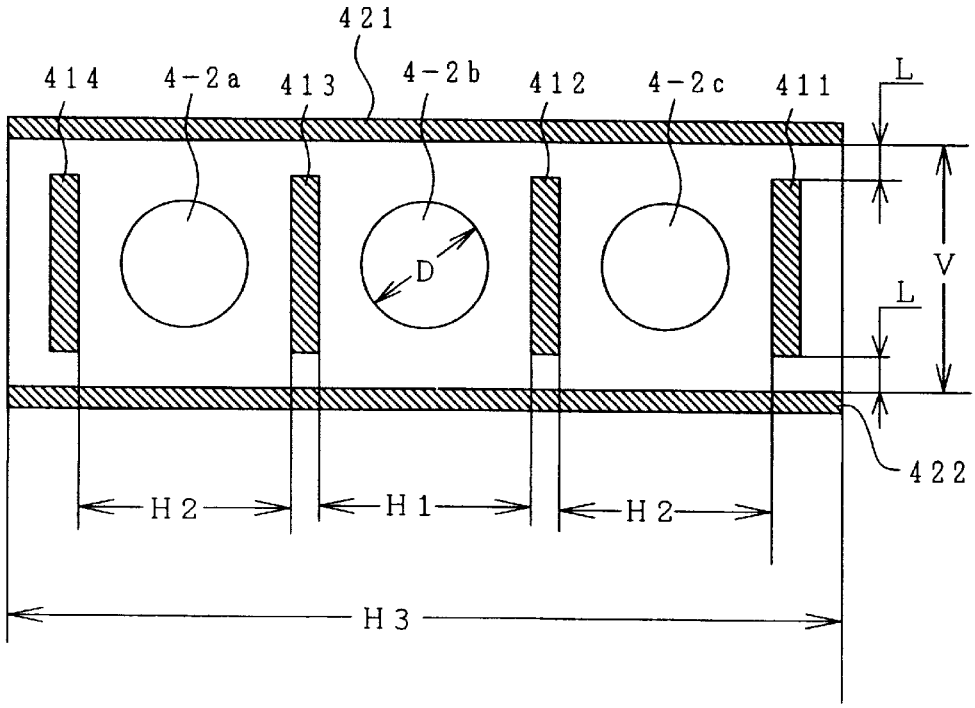
Figure 6A:
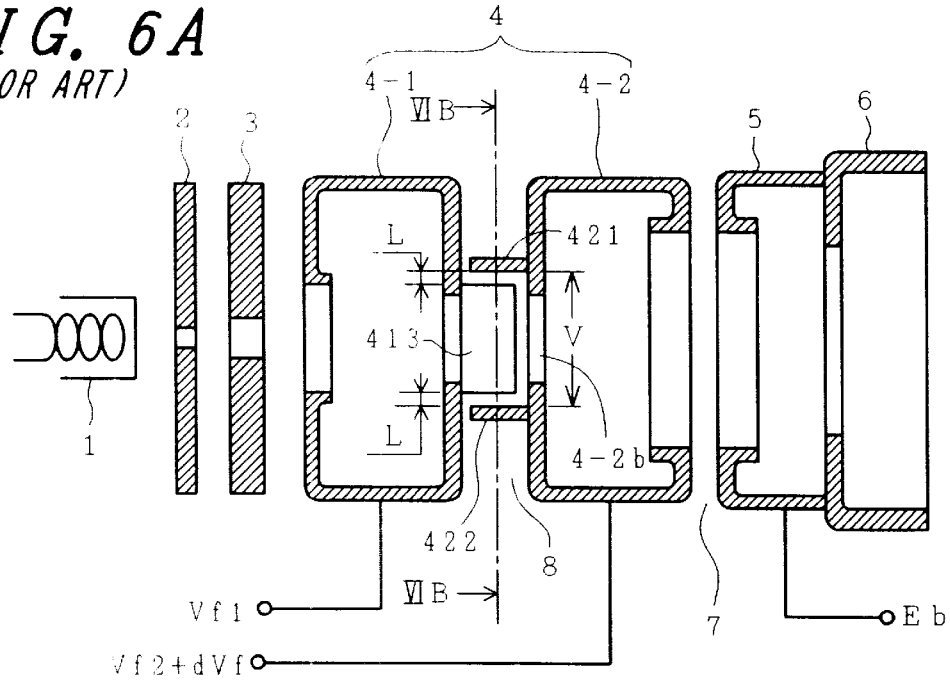
FIG. 6A (PRIOR ART)
FIG. 6A is a vertical cross-sectional view of a three in-line beam electron gun in a color cathode ray tube for explaining a dimensional relationship of the present invention and the prior art.
Figure 6B:
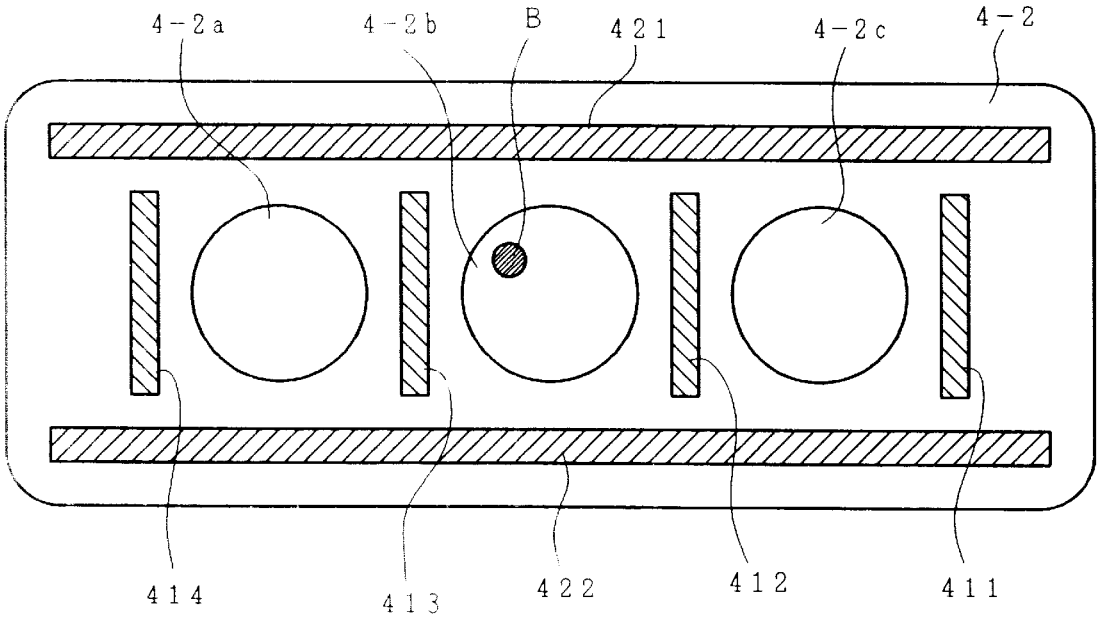
FIG. 6B (PRIOR ART)
FIG. 6B is a cross-sectional view taken along line VIB—VIB of FIG. 6A.
Figure 6C:
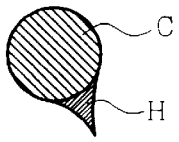
FIG. 6C (PRIOR ART)
FIG. 6C is an illustration of the shape of the electron on a phosphor screen produced by the electron beam B in FIG. 6B.
Figure 7:
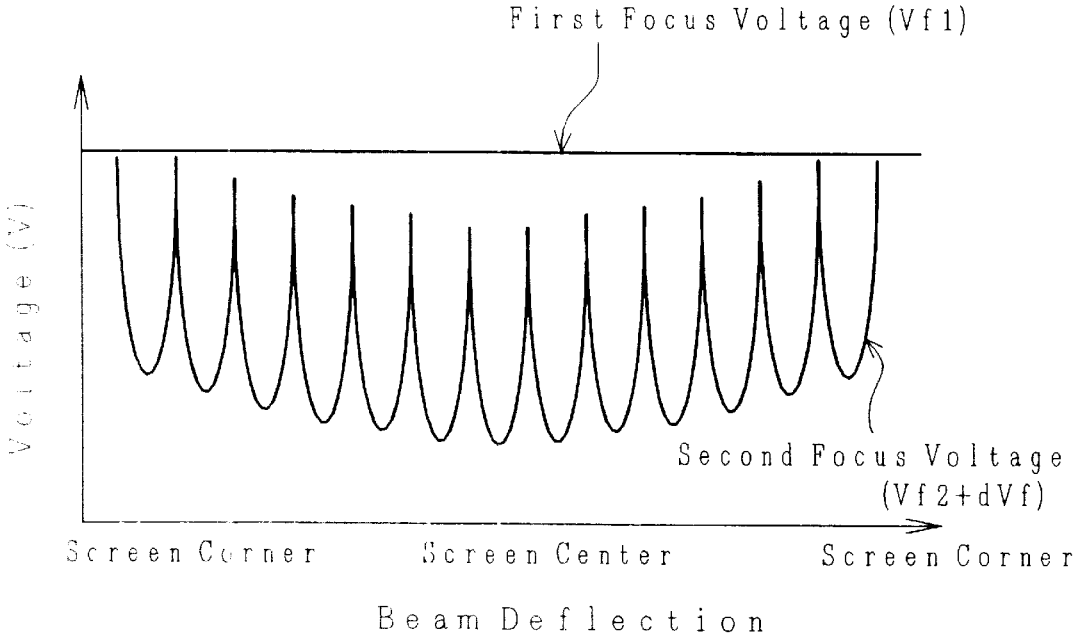
FIG. 7 is illustrations of waveforms applied to focus sub-electrodes.

FIGS. 1A and 1B are illustrations of a first embodiment of an electrostatic quadrupole lens used in an electron gun of a color cathode ray tube of the present invention, FIG. 1A being its perspective view and FIG. 1B being its cross-sectional view taken along line IB—IB of FIG. 1A. The overall structure of the electron gun of the present invention is similar to that in FIG. 6 with the exception of the structure of the present invention and its illustration is omitted.

As shown in FIG. 1A, the electrostatic quadrupole lens is formed by the four vertical parallel plate-like electrodes 411, 412,413,414 disposed to sandwich, in a direction of the in-line beam arrangement, beam apertures 4-1*a*, 4-1*b*, 4-1*c* in the end of the first focus sub-electrode 4-1 facing the second focus sub-electrode 4-2 and electrically connected to the first focus sub-electrode 4-1, and a pair of horizontal parallel plate-like electrodes 421, 422 disposed to sandwich, in a direction perpendicular to the in-line beam arrangement, three beam apertures 4-2*a*, 4-2*b*, 4-2*c* in the end of the second focus sub-electrode 4-2 facing the first focus sub-electrode 4-1 and electrically connected to the second focus sub-electrode 4-2.

In FIG. 1B, by increasing the ratios of a gap L between the horizontal parallel plate-like electrode 421 and the top edge of the vertical parallel plate-like electrodes 411, 412, 413, 414 and a gap L between the horizontal parallel plate-like electrode 422 and the bottom edge of the vertical parallel plate-like electrodes 411, 412, 413, 414, to a vertical spacing V between the horizontal parallel plate-like electrodes 421 and 422 to reduce the lens strength in spaces where the top and bottom edges of the vertical parallel plate-like electrodes 411, 412, 413, 414 are adjacent to the horizontal parallel plate-like electrodes 421, 422, distortions in the quadrupole lens caused in those spaces are reduced.

In color cathode ray tubes, to compensate for manufacturing variations such as a tilt of an electron gun or mechanical misalignment between the panel portion and the funnel portion, electron beam spots have to be moved a distance in a range of ±3 mm on the phosphor screen by beam-adjusting permanent magnets, for example.

As a result, electron beam spots have to be moved a distance in a range of ±3 mm on the phosphor screen without incurring significant deterioration in beam focus. In this specification, an overall distance an electron beam can be moved on the phosphor screen without incurring significant deterioration in beam focus is referred to as a focus margin (mm). The above-explained distance in a range of ±3 mm corresponds to a focus margin of 6 mm. The color cathode ray tube needs a focus margin not less than 6 mm.

Figure 2:
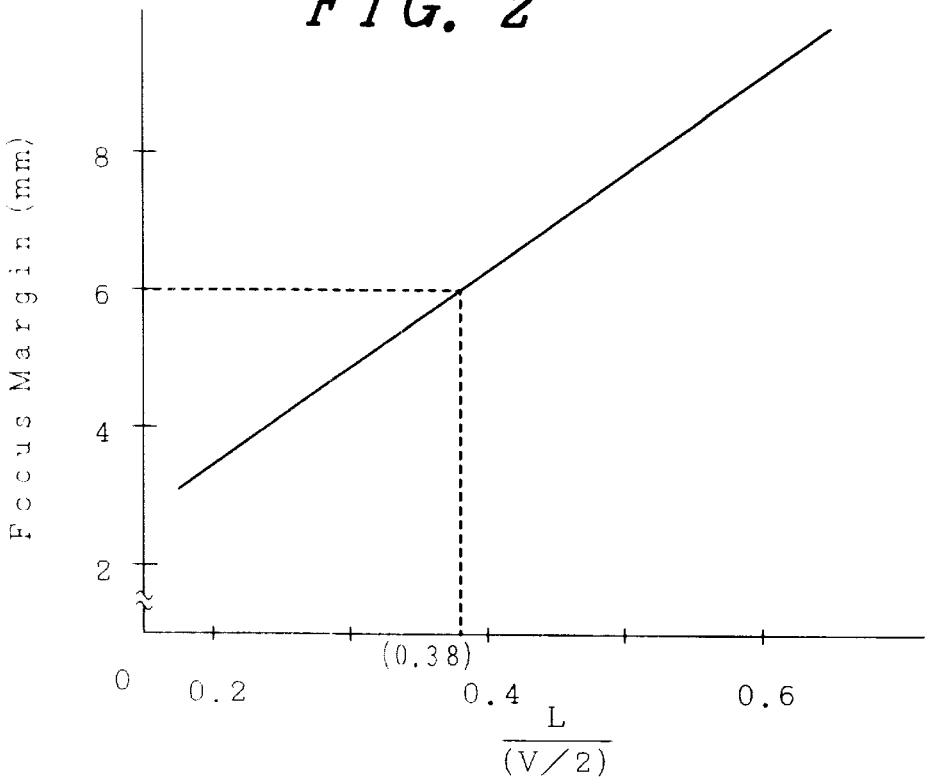
FIG. 2 shows a relationship between the focus margin and the ratio of a gap L between the horizontal parallel plate-like electrodes and the top and bottom edges of the vertical parallel plate-like electrodes to half a vertical spacing V between the horizontal parallel plate-like electrodes.

FIG. 2 shows a relationship between the focus margin and the ratio of a gap L between the horizontal parallel plate-like electrodes and the top and bottom edges of the vertical parallel plate-like electrodes to half a vertical spacing V between the horizontal parallel plate-like electrodes.

FIG. 2 indicates that, to obtain the focus margin not less than 6 mm, the following relationship has to be satisfied:

$$0.38 \leqq L/(V/2) \quad (1)$$

But, in FIG. 1B, the sensitivity of the quadrupole lens as a whole decreases with increase in the ratios of a gap L between the horizontal parallel plate-like electrode 421 and the top edge of the vertical parallel plate-like electrodes 411, 412, 413, 414 and a gap L between the horizontal parallel plate-like electrode 422 and the bottom edge of the vertical parallel plate-like electrodes 411, 412, 413, 414, to a vertical spacing V between the horizontal parallel plate-like electrodes 421 and 422. The inventors know that decrease in the sensitivity of the quadrupole lens by not less than 10% causes significant deterioration in beam focus.

Figure 3:
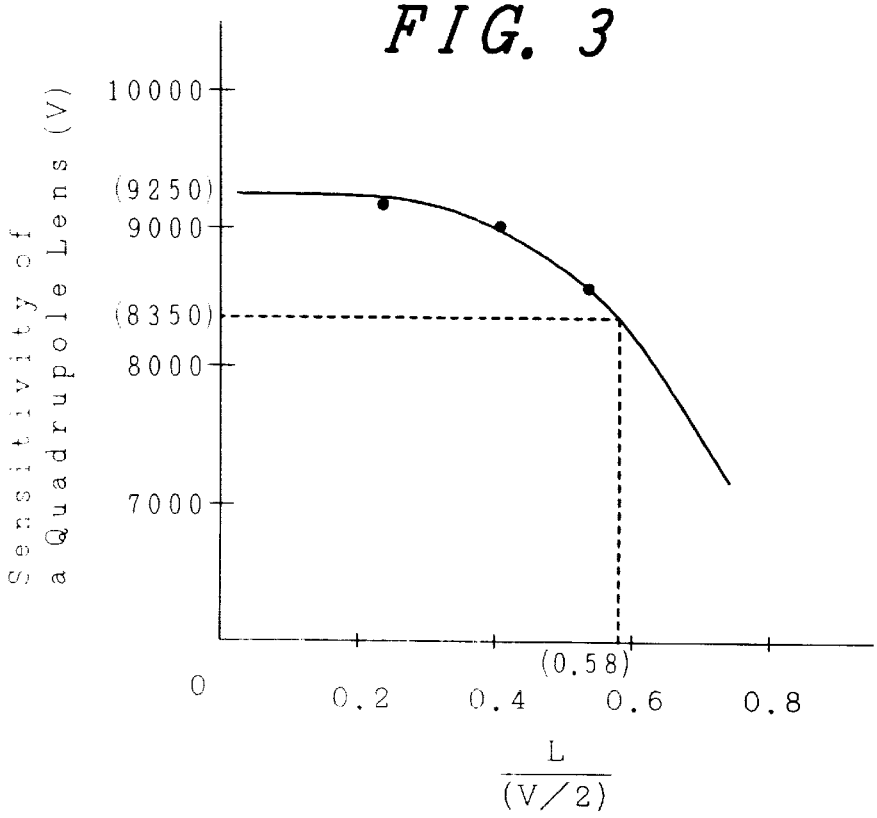
FIG. 3 shows an experimentally-obtained relationship between the sensitivity of the quadrupole lens and the ratio of a gap L between the horizontal parallel plate-like electrodes and the top and bottom edges of the vertical parallel plate-like electrodes to half a vertical spacing V between the horizontal parallel plate-like electrodes.

FIG. 3 shows an experimentally-obtained relationship between the sensitivity of the quadrupole lens and the ratio of a gap L between the horizontal parallel plate-like electrodes and the top and bottom edges of the vertical parallel plate-like electrodes to half a vertical spacing V between the horizontal parallel plate-like electrodes. In FIG. 3, the sensitivity of the quadrupole lens is represented by a voltage difference between an anode voltage adjusted for a minimum horizontal beam spot diameter and that adjusted for a minimum vertical beam spot diameter. If no quadrupole lens is present in the cathode ray tube, this voltage difference is zero.

FIG. 3 indicates that, when L/(V/2) is smaller than 0.2, the sensitivity of the quadrupole lens in terms of an anode voltage is about 9250 V. To keep the reduction in its sensitivity within 10%, that is, to keep the sensitivity in terms of an anode voltage higher than 8350 V, the following relationship has to be satisfied:

$$L/(V/2) \leqq 0.58 \quad (2)$$

The combination of the inequalities (1) and (2) gives the following relationship:

$$0.38 \leqq L/(V/2) \leqq 0.58 \quad (3)$$

This relationship prevents deterioration in beam focus and resolution, in spite of manufacturing variations in electron guns or color cathode ray tubes.

The table below shows the comparison between an inventors' prior proposal and a specific example of the present invention referring to FIGS. 1A and 1B.

| Dimensions | Inventors' Prior Proposal | Specific Example of the Present Invention |
|---|---|---|
| L (mm) | 0.5 | 1.1 |
| V (mm) | 4.2 | 4.2 |
| P1 (mm) | 2.5 | 2.5 |
| P2 (mm) | 2.5 | 2.5 |
| T1 (mm) | 0.5 | 0.5 |
| T2 (mm) | 0.5 | 0.5 |
| H1 (mm) | 2.7 | 2.7 |
| H2 (mm) | 2.5 | 2.5 |
| H3 (mm) | 18.0 | 18.0 |
| D (mm) | 4.0 | 4.0 |
| L/(V/2) | 0.24 | 0.52 |

Figure 8:
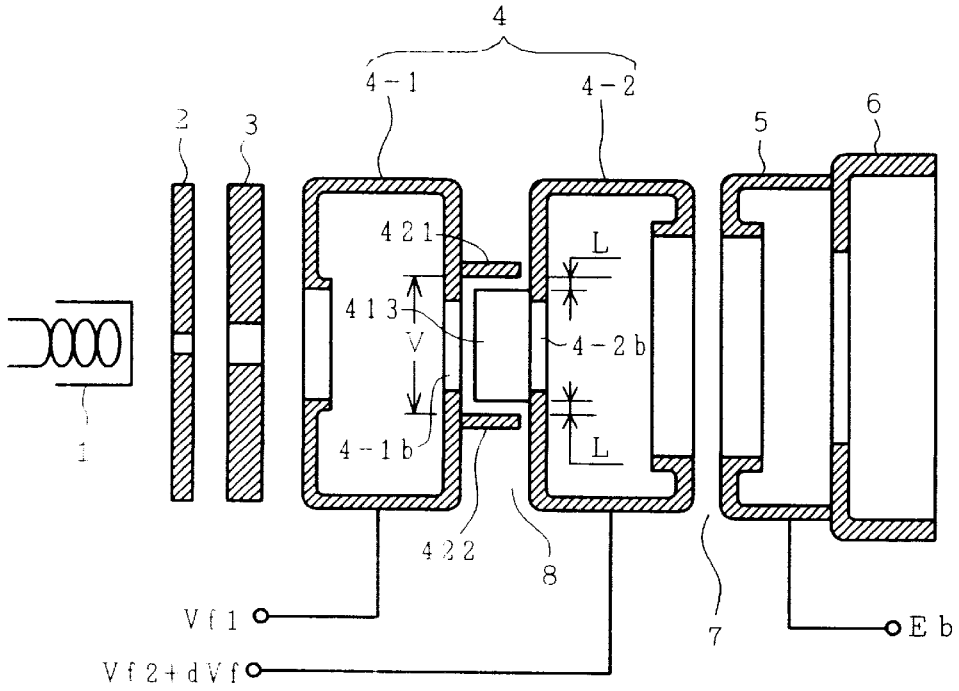
FIG. 8 is a longitudinal cross-sectional view of a second embodiment of an electron gun of a color cathode ray tube of the present invention, taken at right angles to a direction of the three in-line beam arrangement.

FIG. 8 is a longitudinal cross-sectional view of a second embodiment of an electrostatic quadrupole lens used in an electron gun of a color cathode ray tube of the present invention, taken at right angles to a direction of the three-in-line-beam arrangement. The electron gun in this embodiment comprises an electron beam generating section composed of a cathode structure 1, a beam control electrode 2 and an accelerating electrode 3, a focus electrode 4 composed of two focus sub-electrodes, an anode 5, and a shield cup 6.

The arrangement of the plate-like electrodes in this embodiment is the reverse of that of the first embodiment. The electrostatic quadrupole lens are formed by the four vertical parallel plate-like electrodes 411, 412, 413, 414 (only the electrode 413 is shown) disposed to sandwich, in a direction of the in-line beam arrangement, beam apertures 4-2*a*, 4-2*b*, 4-2*c* (only the aperture 4-2*b* is shown) in the end of the second focus sub-electrode 4-2 facing the first focus sub-electrode 4-1 and electrically connected to the second focus sub-electrode 4-2, and a pair of horizontal parallel plate-like electrodes 421, 422 disposed to sandwich, in a direction perpendicular to the in-line beam arrangement, three beam apertures 4-1*a*, 4-1*b*, 4-1*c* (only the aperture 4-1*b* is shown) in the end of the first focus sub-electrode 4-1 facing the second focus sub-electrode 4-2 and electrically connected to the first focus sub-electrode 4-1.

This embodiment also provides the similar advantages as the first embodiment when the inequality (3) is satisfied.

Figure 4:
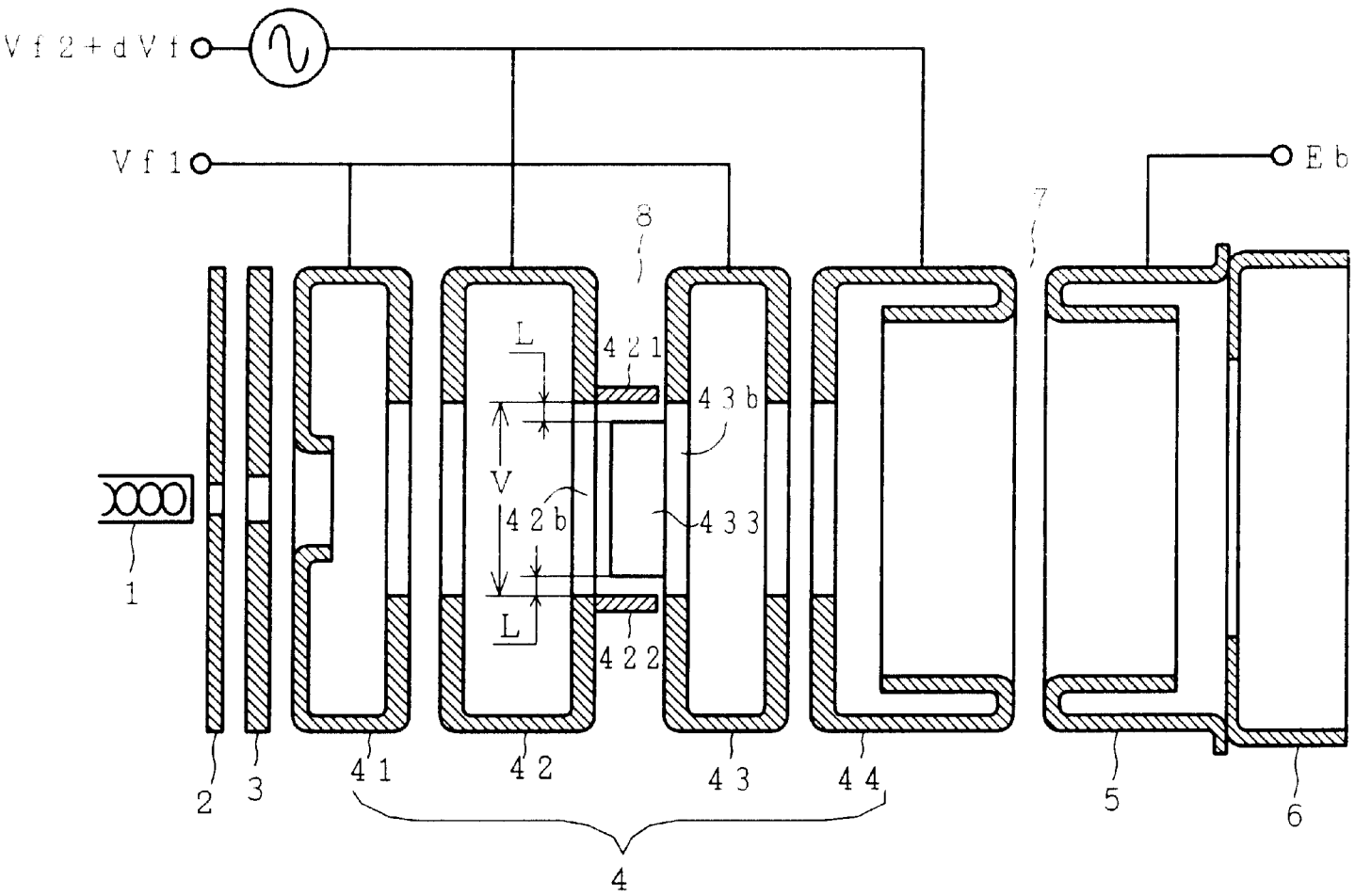
FIG. 4 is a longitudinal cross-sectional view of a third embodiment of an electron gun of a color cathode ray tube of the present invention, taken at right angles to a direction of the three-in-line-beam arrangement.
Figure 5:
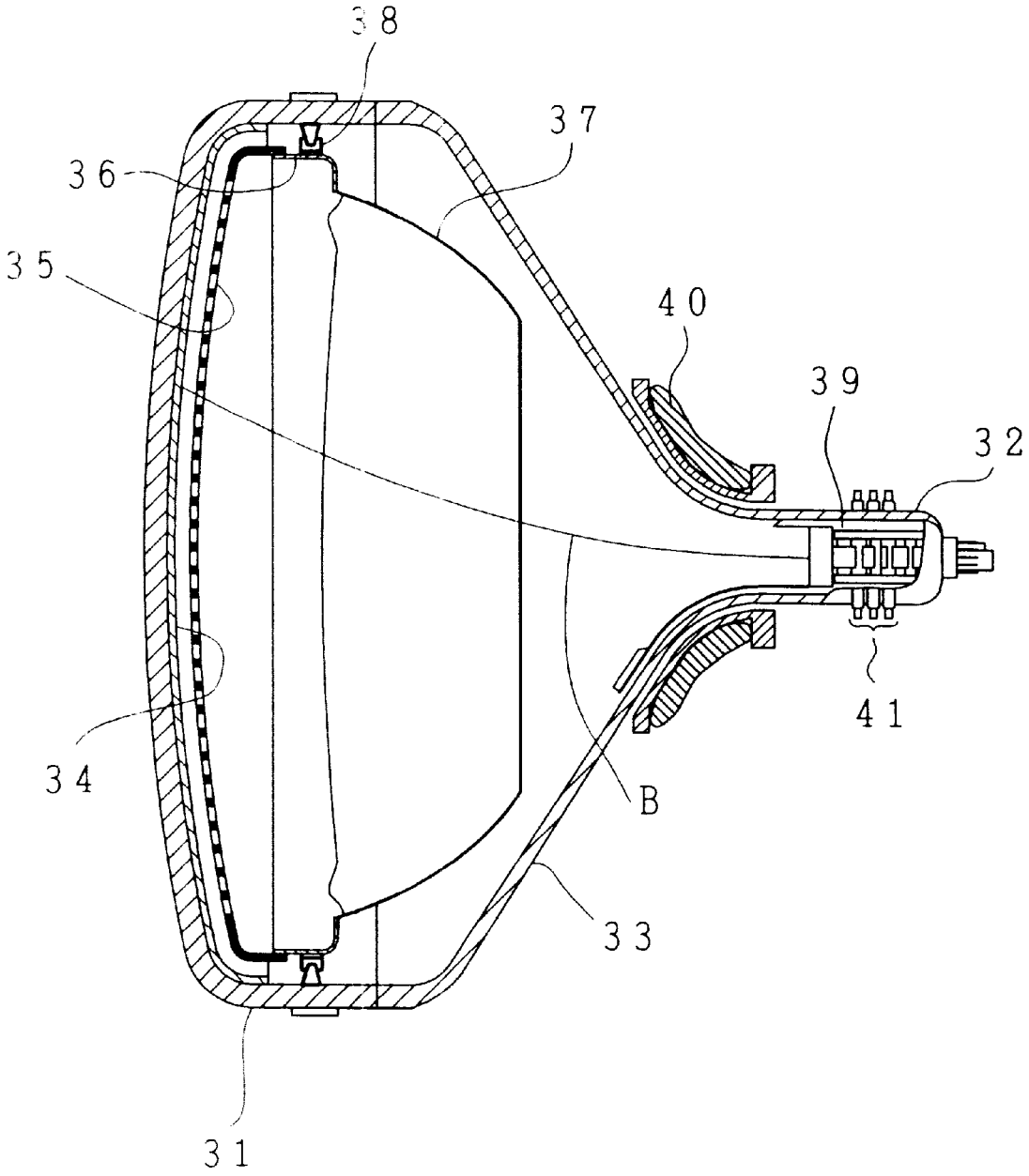
FIG. 5 (PRIOR ART)
FIG. 5 is a longitudinal cross-sectional view of an overall structure of a color cathode ray tube in which the present invention is incorporated.

FIG. 4 is a longitudinal cross-sectional view of a second embodiment of an electrostatic quadrupole lens used in an electron gun of a color cathode ray tube of the present invention, taken at right angles to a direction of the three-in-line-beam arrangement. The electron gun in this embodiment comprises an electron beam generating section composed of a cathode structure 1, a beam control electrode 2 and an accelerating electrode 3, a focus electrode 4 composed of four focus sub-electrodes, an anode 5, and a shield cup 6.

The focus electrode 4 is composed of a first focus sub-electrode 41, a second focus sub-electrode 42, a third focus sub-electrode 43 and a fourth focus sub-electrode 44. An electrostatic quadrupole lens 8 is formed between the opposing ends of the second focus sub-electrode 42 and the third focus sub-electrode 43, and a main lens 7 is formed between the opposing ends of the fourth focus sub-electrode 44 and the anode 5.

A pair of horizontal parallel plate-like electrodes 421, 422 are disposed above and below beam apertures 42*a*, 42*b*, 42*c* (only the beam aperture 42*b* is shown) in the end of the second focus sub-electrode 42 facing the third focus sub-electrode 43, and four vertical parallel plate-like electrodes 431, 432, 433, 434 are attached to the end of the third focus sub-electrode 43 facing the second focus sub-electrode 42 to sandwich beam apertures 43*a*, 43*b*, 43*c* (only the beam aperture 43*b* is shown) in the third focus sub-electrode 43 in the direction of the three in-line beam arrangement. In FIG. 3, only the vertical parallel plate-like electrode 433 is shown because FIG. 3 is an axial cross-sectional view of the three in-line beam electron gun.

The electrostatic quadrupole lens. 8 is formed by the two horizontal parallel plate-like electrodes 421, 422 and the four vertical parallel plate-like electrodes 431, 432, 433, 434.

The first and third focus sub-electrodes 41, 43 are supplied with a fixed voltage Vf1, and the second and fourth focus sub-electrodes 42, 44 are supplied with a dynamic voltage (Vf2+dVf) varying in synchronism with deflection of the electron beams scanned on the phosphor screen. The anode 5 is supplied with an anode voltage Eb which is highest within the cathode ray tube.

With this structure, the strength of the main lens 7 is varied with deflection of the electron beams to correct the curvature of the image field, astigmatism is corrected by the electrostatic quadrupole lens 8 formed between the second and third focus sub-electrodes 42, 43 with deflection of the electron beams such that focus lengths of the electron beams and the shapes of the electron beams on the phosphor screen are controlled to provide good focus over the entire phosphor screen.

The electrostatic quadrupole lens 8 is configured such that the quadrupole lens is formed in a space where two horizontal parallel plate-like electrodes 421, 422 and four vertical parallel plate-like electrodes 431, 432, 433, 434 overlap each other. The strength of the quadrupole lens increases with increase in the overlapped length of the plate-like electrodes.

As in the case of the first embodiment, when the ratio L/(V/2) of a gap L between the horizontal parallel plate-like electrodes 421, 422 and the top and bottom edges of the vertical parallel plate-like electrodes 431, 432, 433, 434 to half a vertical spacing V between the horizontal parallel plate-like electrodes 421, 422 in FIG. 4 satisfies the following relationship:

$$0.38 \leqq L/(V/2) \leqq 0.58,$$

the electron gun secures the desired focus margin and the desired sensitivity of the quadrupole lens, and prevents deterioration in beam focus and resolution, in spite of manufacturing variations in electron guns or color cathode ray tubes.

Figure 9:
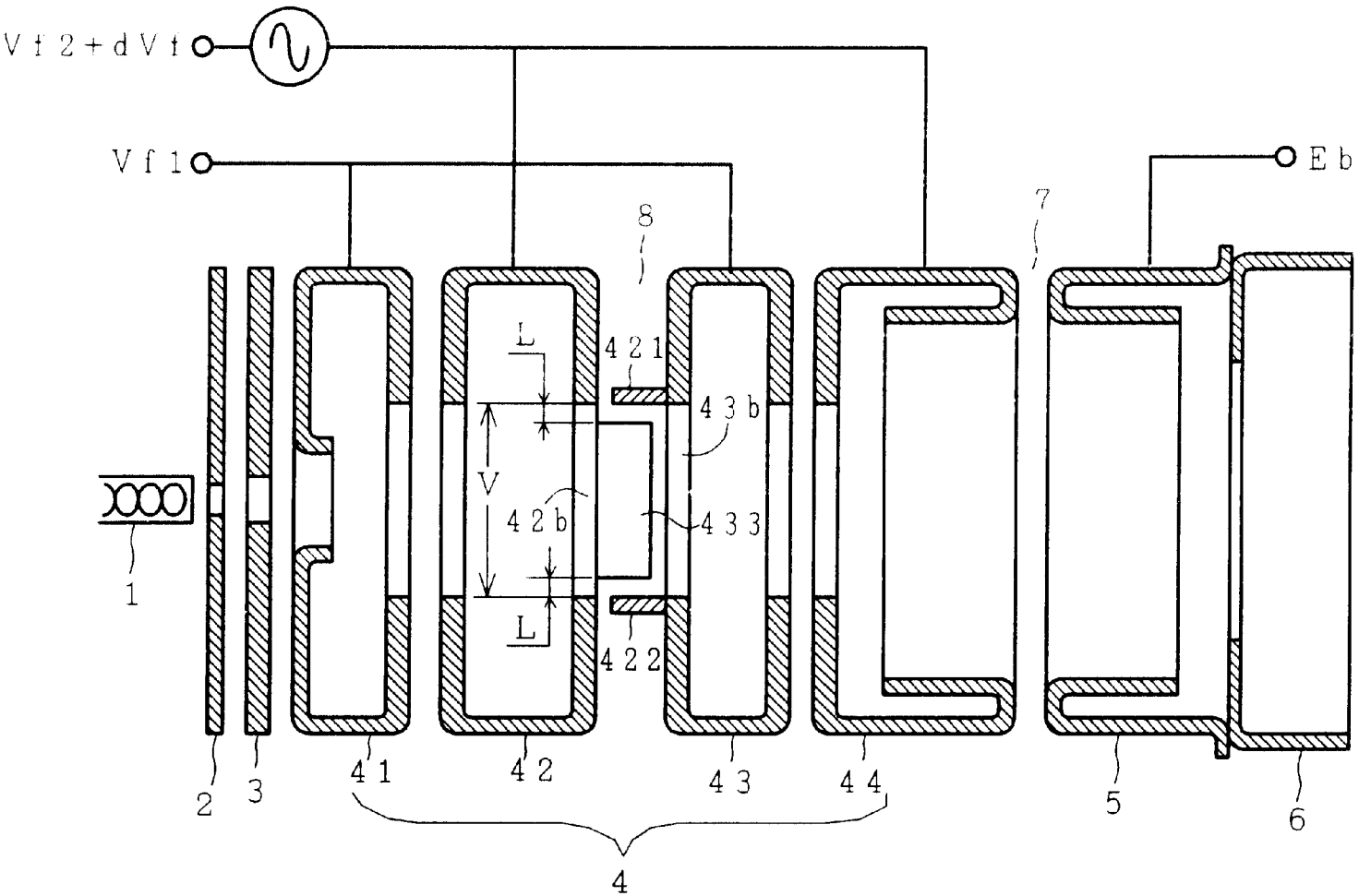
FIG. 9 is a longitudinal cross-sectional view of a fourth embodiment of an electron gun of a color cathode ray tube of the present invention, taken at right angles to a direction of the three in-line beam arrangement.

FIG. 9 is a longitudinal cross-sectional view of a fourth embodiment of an electrostatic quadrupole lens used in an electron gun of a color cathode ray tube of the present invention, taken at right angles to a direction of the three-in-line-beam arrangement. The electron gun in this embodiment comprises an electron beam generating section composed of a cathode structure 1, a beam control electrode 2 and an accelerating electrode 3, a focus electrode 4 composed of four focus sub-electrodes, an anode 5, and a shield cup 6.

The arrangement of the plate-like electrodes in this embodiment is the reverse of that of the third embodiment. The electrostatic quadrupole lens 8 is formed by the four vertical parallel plate-like electrodes 431, 432, 433, 434 (only the electrode 433 is shown) disposed to sandwich, in a direction of the in-line beam arrangement, beam apertures 42*a*, 42*b*, 42*c* (only the aperture 42*b* is shown) in the end of the second focus sub-electrode 42 facing the third focus sub-electrode 43 and electrically connected to the second focus sub-electrode 42, and a pair of horizontal parallel plate-like electrodes 421, 422 disposed to sandwich, in a direction perpendicular to the in-line beam arrangement, three beam apertures 43*a*, 43*b*, 43*c* (only the aperture 43*b* is shown) in the end of the third focus sub-electrode 43 facing the second focus sub-electrode 42 and electrically connected to the third focus sub-electrode 43.

This embodiment also provides the similar advantages as the third embodiment when the inequality (3) is satisfied.

Figure 10:
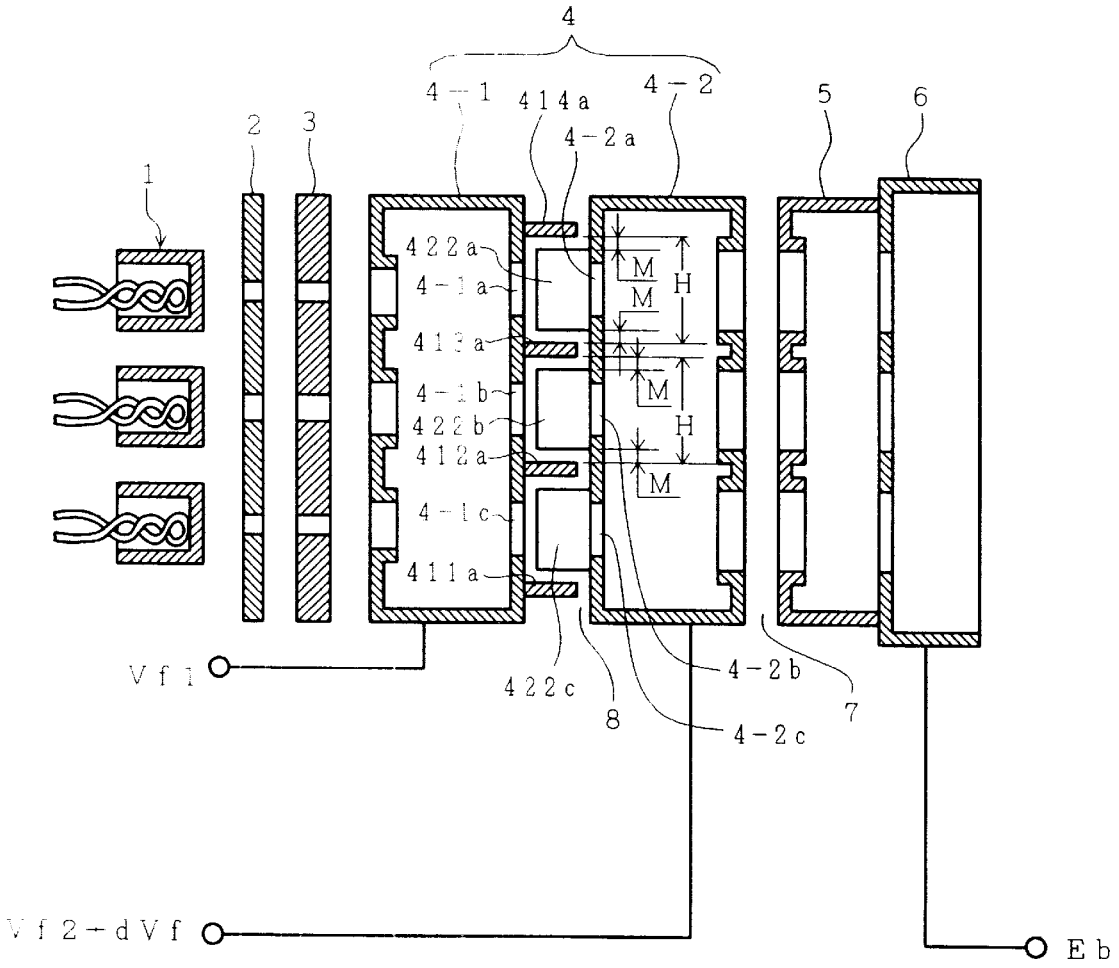
FIG. 10 is a longitudinal cross-sectional view of a fifth embodiment of an electrostatic quadrupole lens used in an electron gun of a color cathode ray tube of the present invention, taken in a direction of the three-in-line-beam arrangement.
Figure 11A:
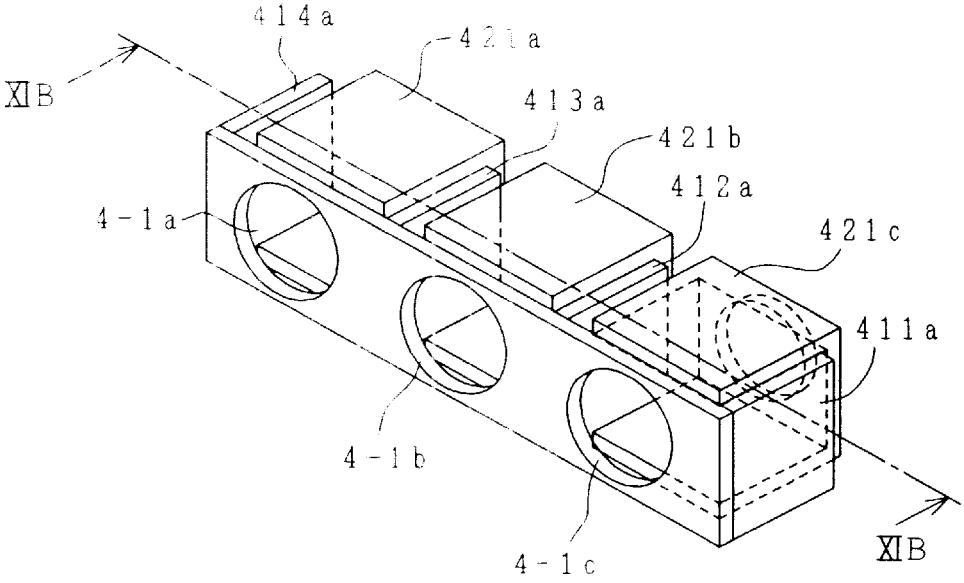
FIGS. 11A and 11B are illustrations of an electrostatic quadrupole lens 8 of FIG. 10, FIG. 11A being its perspective view and FIG. 11B being its cross-sectional view taken along line XIB—XIB of FIG. 11A.

FIG. 10 is a longitudinal cross-sectional view of a fifth embodiment of an electrostatic quadrupole lens used in an electron gun of a color cathode ray tube of the present invention, taken in a direction of the three-in-line-beam arrangement. The electron gun in this embodiment comprises an electron beam generating section composed of a cathode structure 1, a beam control electrode 2 and an accelerating electrode 3, a focus electrode 4 composed of two focus sub-electrodes 4-1, 4-2, an anode 5, and a shield cup 6. FIGS. 11A and 1B are illustrations of an electrostatic quadrupole lens 8 of FIG. 10, FIG. 11A being its perspective view and FIG. 11B being its cross-sectional view taken along line XIB—XIB of FIG. 11A.

The electrostatic quadrupole lens 8 is formed by the four vertical parallel plate-like electrodes 411*a*, 412*a*, 413*a*, 414*a* disposed to sandwich, in a direction of the in-line beam arrangement, beam apertures 4-1*a*, 4-1*b*, 4-1*c* in the end of the first focus sub-electrode 4-1 facing the second focus sub-electrode 4-2 and electrically connected to the first focus sub-electrode 4-1, and three pairs of horizontal parallel plate-like electrodes (421*a*, 422*a*); (421*b*, 422*b*); (421*c*, 422*c*) disposed to sandwich, in a direction perpendicular to the in-line beam arrangement, three beam apertures 4-2*a*, 4-2*b*, 4-2*c* in the end of the second focus sub-electrode 4-2 facing the first focus sub-electrode 4-1 and electrically connected to the second focus sub-electrode 4-2.

Figure 11B:
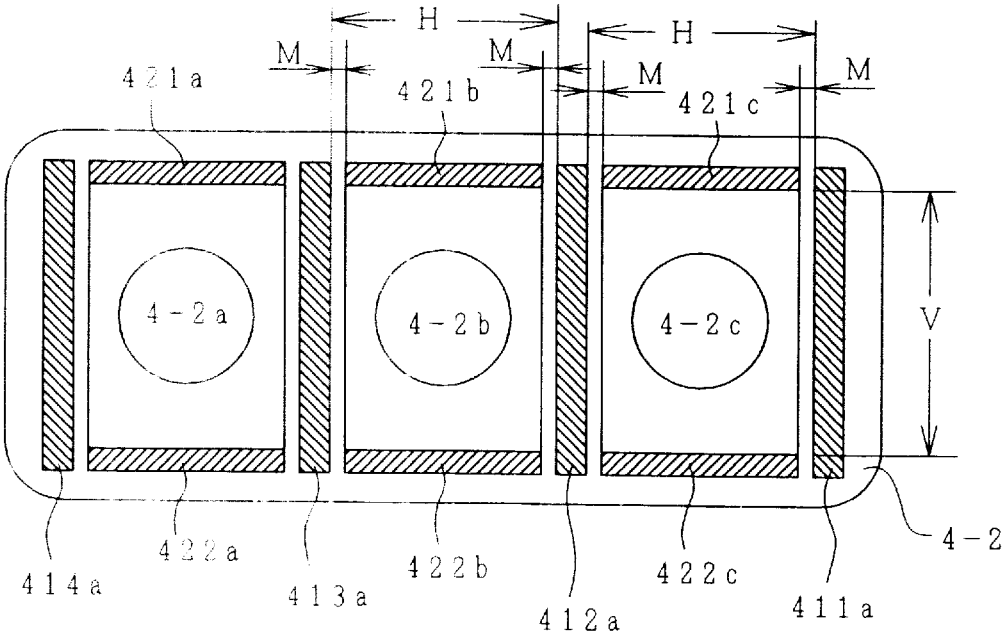

Unlike the previous embodiments, in this embodiment, the four vertical parallel plate-like electrodes 411*a*, 412*a*, 413*a*, 414*a* extends longer in a vertical direction than a vertical spacing V between a respective pair of horizontal parallel plate-like electrodes (421*a*, 422*a*), (421*b*, 422*b*) and (421*c*, 422*c*) as shown in FIG. 11B.

To reduce distortions in the quadrupole lens 8 explained in connection with the first embodiment, in analogy with the case of the first embodiment, when the ratio M/(H/2) of a gap M between the horizontal parallel plate-like electrodes 421*a*, 421*b*, 421*c*, 422*a*, 422*b*, 422*c* and the vertical parallel plate-like electrodes 411*a*, 412*a*, 413*a* to half a horizontal spacing H between two adjacent ones of the vertical parallel plate-like electrodes 411*a*, 412*a*, 413*a* in FIG. 11B satisfies the following relationship:

$$0.38 \leqq M/(H/2) \leqq 0.58,$$

the electron gun secures the desired focus margin and the desired sensitivity of the quadrupole lens, and prevents deterioration in beam focus and resolution, in spite of manufacturing variations in electron guns or color cathode ray tubes.

A plurality of electrostatic quadrupole lenses in accordance with the present invention can be disposed at a plurality of different positions along the longitudinal axis of a cathode ray tube.

As described above, according to one embodiment of the present invention, there is provided a cathode ray tube having an electrostatic quadrupole lens formed by a pair of horizontal parallel plate-like electrodes disposed to sandwich three beam apertures in a direction perpendicular to the three in-line beam arrangement, and the four vertical parallel plate-like electrodes disposed to sandwich the respective beam apertures in the direction of the in-line beam arrangement such that the four vertical parallel plate-like electrodes extend into a space between the pair of horizontal parallel plate-like electrodes, which is capable of displaying a high quality image by preventing deterioration in resolution due to that in beam focus, in spite of manufacturing variations in an electron gun or a color cathode ray tube.

What is claimed is:

1. A color cathode ray tube comprising a phosphor screen, an electron beam generating section having a cathode structure, a beam control electrode and an accelerating electrode for generating and controlling three electron beams arranged horizontally, a focus electrode and an anode constituting a main lens therebetween for focusing said three electron beams on said phosphor screen, said focus electrode including at least a first focus sub-electrode and a second focus sub-electrode on the order named from said cathode structure, said first focus sub-electrode having a plurality of vertical parallel plate-like electrodes arranged to sandwich respective beam apertures in an end thereof facing said second focus sub-electrode in a direction of an arrangement of said three electron beams and electrically connected to said first focus sub-electrode, said second focus sub-electrode having a plurality of horizontal parallel plate-like electrodes arranged to sandwich beam apertures in an end thereof facing said first focus sub-electrode in a direction perpendicular to said arrangement of said three electron beams and electrically connected to said second focus sub-electrode, one of said first focus sub-electrode and said second focus sub-electrode being adapted to be supplied with a voltage varying in synchronism with deflection of said three electron beams, said plurality of vertical parallel plate-like electrodes extending into a space defined by said plurality of horizontal parallel plate-like electrodes, and a vertical spacing V between said plurality of horizontal parallel plate-like electrodes and a gap L between said plurality of horizontal parallel plate-like electrodes and a top edge of said plurality of vertical parallel plate-like electrodes and a gap L between said plurality of horizontal parallel plate-like electrodes and a bottom edge of said plurality of vertical parallel plate-like electrodes satisfying a following relationship:

$$0.38 \leqq L/(V/2) \leqq 0.58.$$

2. A color cathode ray tube comprising a phosphor screen, an electron beam generating section having a cathode-structure, a beam control electrode and an accelerating electrode for generating and controlling three electron beams arranged horizontally, a focus electrode and an anode constituting a main lens therebetween for focusing said three electron beams on said phosphor screen, said focus electrode including at least a first focus sub-electrode and a second focus sub-electrode on the order named from said cathode structure, said first focus sub-electrode having a plurality of horizontal parallel plate-like electrodes arranged to sandwich respective beam apertures in an end thereof facing said second focus sub-electrode in a direction perpendicular to an arrangement of said three electron beams and electrically connected to said first focus sub-electrode, said second focus sub-electrode having a plurality of vertical parallel plate-like electrodes arranged to sandwich beam apertures in an end thereof facing said first focus sub-electrode in a direction of said arrangement of said three electron beams and electrically connected to said second focus sub-electrode, one of said first focus sub-electrode and said second focus sub-electrode being adapted to be supplied with a voltage varying in synchronism with deflection of said-three electron beams, said plurality of vertical parallel plate-like electrodes extending into a space defined by said plurality of horizontal parallel plate-like electrodes, and a vertical spacing V between said plurality of horizontal parallel plate-like electrodes and a gap L between said plurality of horizontal parallel plate-like electrodes and a top edge of said plurality of vertical parallel plate-like electrodes and a gap L between said plurality of horizontal parallel plate-like electrodes and a bottom edge of said plurality of vertical parallel plate-like electrodes satisfying a following relationship:

$$0.38 \leqq L/(V/2) \leqq 0.58.$$

3. A color cathode ray tube comprising a phosphor screen, an electron beam generating section having a cathode structure, a beam control electrode and an accelerating electrode for generating and controlling three electron beams arranged horizontally, a focus electrode and an anode constituting a main lens therebetween for focusing said three electron beams on said phosphor screen, said focus electrode including at least a first focus sub-electrode and a second focus sub-electrode on the order named from said cathode structure, said first focus sub-electrode having a plurality of vertical parallel plate-like electrodes arranged to sandwich respective beam apertures in an end thereof facing said second focus sub-electrode in a direction of an arrangement of said three electron beams and electrically connected to said first focus sub-electrode, said second focus sub-electrode having a plurality of horizontal parallel plate-like electrodes arranged to sandwich respective beam apertures in an end thereof facing said first focus sub-electrode in a direction perpendicular to said arrangement of said three electron beams and electrically connected to said second focus sub-electrode, one of said first focus sub-electrode and said second focus sub-electrode being adapted to be supplied with a voltage varying in synchronism with deflection of said three electron beams, each of said plurality of horizontal parallel plate-like electrodes extending into a space defined by two adjacent ones of said plurality of vertical parallel plate-like electrodes, and a horizontal spacing H between two adjacent ones of said plurality of vertical parallel plate-like electrodes and a horizontal gap M between said plurality of horizontal parallel plate-like electrodes and said plurality of vertical parallel plate-like electrodes satisfying a following relationship:

$$0.38 \leqq M/(H/2) \leqq 0\text{–}58.$$

4. A color cathode ray tube comprising a phosphor screen, an electron beam generating section having a cathode structure, a beam control electrode and an accelerating electrode for generating and controlling three electron beams arranged horizontally, a focus electrode and an anode constituting a main lens therebetween for focusing said three electron beams on said phosphor screen, said focus electrode including at least a first focus sub-electrode and a second focus sub-electrode on the order named from said cathode structure, said first focus sub-electrode having a first plurality of plate-like electrodes parallel in one of two directions parallel and perpendicular to an arrangement of said three electron beams, arranged to sandwich beam apertures in an end thereof facing said second focus sub-electrode in the other of said two directions and electrically connected to said first focus sub-electrode, said second focus sub-electrode having a second plurality of plate-like electrodes parallel in the other of said two directions, arranged to sandwich beam apertures in an end thereof facing said first focus sub-electrode in the one of said two directions and electrically connected to said second focus sub-electrode, one of said first focus sub-electrode and said second focus sub-electrode being adapted to be supplied with a voltage varying in synchronism with deflection of said three electron beams, one of (i) said first plurality plate-like electrodes parallel in the one of said two directions and (ii) said second plurality of plate-like electrodes parallel in the other of said two directions extending between the other of (i) said first plurality of plate-like electrodes parallel in the one of said two directions and (ii) said second plurality of plate-like electrodes in the one of said two directions, and a spacing S between two adjacent electrodes of the other of (i) said first plurality of plate-like electrodes parallel in the one of two directions and (ii) said second plurality of plate-like electrodes parallel in the other of said two directions, and a gap G between one electrode of said one of (i) said first plurality of plate-like electrodes parallel in the one of said two directions and (ii) said second plurality of plate-like electrodes parallel in the other of said two directions and one electrode of the other of (i) said first plurality of plate-like electrodes parallel in the one of said two directions and (ii) said second plurality of plate-like electrodes parallel in the other of said two directions satisfying a following relationship:

$$0.38 \leqq G/(S/2) \leqq 0.58.$$

* * * * *